US009970178B2

(12) United States Patent
Kobayashi

(10) Patent No.: US 9,970,178 B2
(45) Date of Patent: May 15, 2018

(54) CONSTRUCTION MACHINE

(71) Applicant: Hitachi Construction Machinery Co., Ltd., Taito-ku, Tokyo (JP)

(72) Inventor: Shintaro Kobayashi, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days. days.

(21) Appl. No.: 15/370,366

(22) Filed: Dec. 6, 2016

(65) Prior Publication Data

US 2017/0284065 A1 Oct. 5, 2017

(30) Foreign Application Priority Data

Mar. 31, 2016 (JP) ..... 2016-071514

(51) Int. Cl.
*E02F 9/24* (2006.01)
*E02F 3/627* (2006.01)
(Continued)

(52) U.S. Cl.
CPC ..... *E02F 9/2271* (2013.01); *E02F 3/325* (2013.01); *E02F 3/76* (2013.01); *E02F 3/7609* (2013.01);
(Continued)

(58) Field of Classification Search
CPC ..... E02F 9/22; E02F 3/84; E02F 3/76; E02F 3/7609; E02F 9/2271; E02F 3/844;
(Continued)

(56) References Cited

U.S. PATENT DOCUMENTS 4,384,620 A * 5/1983 Uchida ..... E02F 3/8157 172/701.3
5,046,565 A * 9/1991 Purcell ..... E02F 3/7609 172/239
(Continued)

FOREIGN PATENT DOCUMENTS

DE 1922746 A1 * 11/1969 ..... E02F 3/7609
EP 2 765 241 A1 8/2014
(Continued)

OTHER PUBLICATIONS

Extended European Search Report issued in counterpart European Application No. 16202573.8 dated Jun. 27, 2017 (Seven (7) pages).

*Primary Examiner* — John Weiss
(74) *Attorney, Agent, or Firm* — Crowell & Moring LLP

(57) ABSTRACT

A construction machine includes an earth removing implement 20 including: a blade 22 disposed on a base portion frame 21 by using a linkage mechanism 23 and a cylinder 24; a fixed cover 26 positioned above the linkage mechanism 23; a movable cover 27 covering a gap between the fixed cover 26 and the blade 22; and a guide pin 25 that guides the movable cover 27 while the blade 22 is being raised. The movable cover 27 includes a side surface portion 52 having a slot 54 with which the guide pin 25 engages. The slot 54 is formed along the side surface portion 52 that faces the guide pin 25. The guide pin 25 engages with the slot 54 at a lower end position therein when the blade 22 is raised to a highest position as the movable cover 27 is rotated to follow the fixed cover 26.

5 Claims, 4 Drawing Sheets

(51) Int. Cl.

| | |
|---|---|
| ***E02F 9/22*** | (2006.01) |
| ***E02F 3/76*** | (2006.01) |
| ***E02F 3/84*** | (2006.01) |
| ***E02F 3/32*** | (2006.01) |
| ***E02F 3/815*** | (2006.01) |
| ***E02F 9/00*** | (2006.01) |
| *E02F 3/96* | (2006.01) |

(52) U.S. Cl.
CPC ..... *E02F 3/815* (2013.01); *E02F 3/844* (2013.01); *E02F 9/00* (2013.01); *E02F 3/769* (2013.01); *E02F 3/964* (2013.01)

(58) Field of Classification Search
CPC ... E02F 3/325; E02F 3/815; E02F 9/00; E02F 3/769; E02F 3/964
USPC ..... 172/112, 91, 815
See application file for complete search history.

(56) References Cited

U.S. PATENT DOCUMENTS

| | | | | |
|---|---|---|---|---|
| 2006/0108309 | A1* | 5/2006 | Sato | E02F 3/325 212/232 |
| 2014/0318818 | A1* | 10/2014 | Nakata | E02F 3/769 172/788 |

FOREIGN PATENT DOCUMENTS

| | | | |
|---|---|---|---|
| JP | 10-219732 | A | 8/1998 |
| JP | 2010-104302 | A | 5/2010 |
| JP | 2011-157702 | A | 8/2011 |
| KR | 10-2010-0101908 | A | 9/2010 |
| WO | WO 2013/051694 | A1 | 4/2013 |

* cited by examiner

CONSTRUCTION MACHINE

BACKGROUND OF THE INVENTION

1. Field of the Invention

The present invention relates to a construction machine including an earth removing implement.

2. Description of the Related Art

Some construction machines such as hydraulic excavators include an earth removing implement disposed at at least either a front or a rear of a track structure (see, for example, WO 2013/051694). The earth removing implement is utilized to, for example, stop earth and sand such that the earth and sand are not stagnant under a vehicle body during work, in addition to earth removing operations.

SUMMARY OF THE INVENTION

The earth removing implement includes a cylinder and a linkage mechanism and is configured so as to be capable of raising and lowering a blade according to use. The earth removing implement is configured such that the blade can be raised to a stowed position away from a ground surface when the earth removing implement is not in use. With the earth removing implement disclosed in WO 2013/051694, in particular, the cylinder and other parts are protected by a sub-cover and a main cover. The sub-cover covers upper sides of the cylinder and other parts. The main cover covers a gap between the sub-cover and the blade. The main cover has a side surface in which a slot that is engaged by a guiding bolt provided in a link is formed. As the blade moves up and down, the slot is guided by the bolt to thereby cause the main cover to tilt in an anterior-posterior direction to change posture, while moving in a vertical direction. More specifically, when the blade is lowered to a ground position at which the blade contacts the ground, the main cover lowers while standing upright to thereby cover a front side of the cylinder and other parts. When the blade is raised up to the stowed position, the main cover goes up to take a lying down posture above the sub-cover and the blade.

In the earth removing implement disclosed in WO 2013/051694, however, the guiding bolt is provided on the link, thereby the bolt goes up with the link when the blade is to be stowed. At this time, the bolt moves upward relative to the slot in the side surface of the main cover. The bolt is positioned at an upper end in the slot when the blade reaches the stowed position. As a result, under a condition in which the blade is raised to be disposed at the stowed position, the slot in the side surface of the main cover extends below the guiding bolt (see FIG. 4 of WO 2013/051694). Thus, the main cover cannot be constrained against a force to raise the main cover by the engagement between the bolt and the slot. Should an external force be applied, therefore, the main cover can be raised. The earth removing implement is also configured such that the main cover lies down by its own weight when the blade is raised to the stowed position. Should a foreign object be wedged in a pivot about which the main cover rotates or should the pivot be deformed, therefore, the main cover may fail to lie flat due to improper pivotal motion of the main cover. Because the main cover is brought close to a swing structure during stowage of the blade, the dislocated main cover may interfere with the swing structure, resulting in a damage to the main cover or the like.

It is an object of the present invention to provide a construction machine including an earth removing implement that can prevent interference with a swing structure.

To achieve the foregoing object, the present invention provides, in one aspect, a construction machine that includes: a track structure; a swing structure provided swingably at an upper portion of the track structure; and an earth removing implement provided at at least either a front portion or a rear portion of the track structure. The earth removing implement includes: a base portion frame mounted on the track structure; a blade mounted on the base portion frame by using a linkage mechanism and a cylinder such that the blade can be raised and lowered; a fixed cover supported on the base portion frame and positioned above the linkage mechanism; a movable cover that covers a gap between the fixed cover and the blade; and a guide pin that guides the movable cover while the blade is being raised and lowered. In the construction machine, the guide pin is supported on the base portion frame; the movable cover includes a main surface portion having a lower end connected rotatably with the blade and having an upper portion leaning on the fixed cover, the movable cover further including a side surface portion having a slot with which the guide pin engages; and the slot is formed along positions of the side surface portion of the movable cover facing the guide pin when the movable cover rotates by having the upper portion of the main surface portion sliding over the fixed cover in accordance with a raising/lowering operation of the blade, the slot being configured such that the guide pin engages with the slot at a lower end position therein when the blade is raised to a highest position.

The present invention can prevent interference with the swing structure.

DESCRIPTION OF THE PREFERRED EMBODIMENT

The embodiment of the present invention will be described below with reference to the accompanying drawings.

1. Construction Machine

Figure 1:
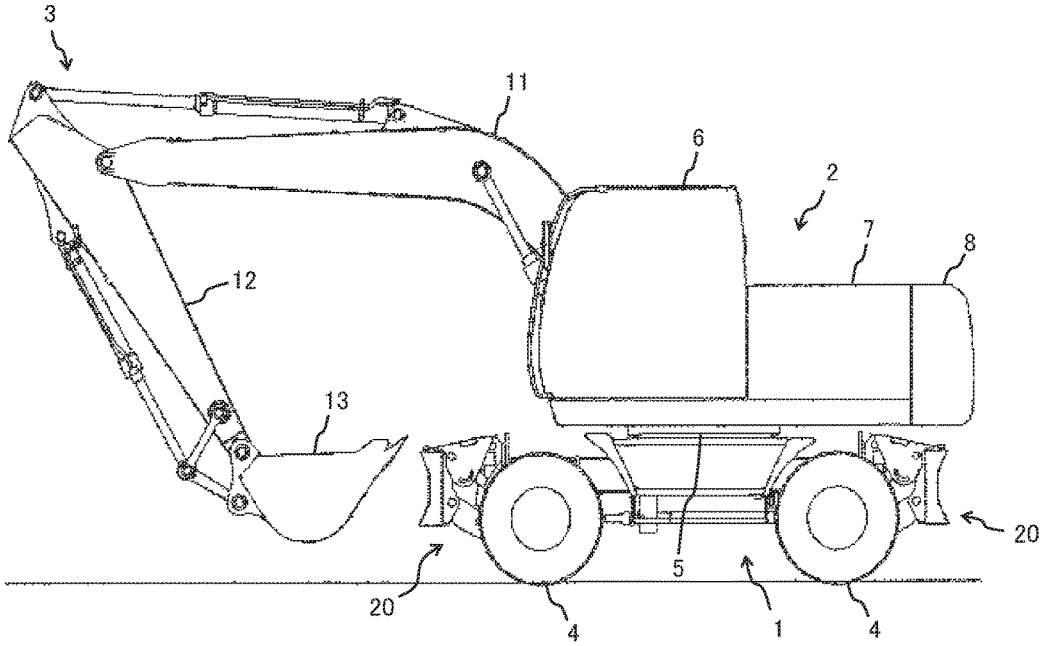
FIG. 1 is a side view of a wheel type hydraulic excavator as an exemplary construction machine according to an embodiment of the present invention.

FIG. 1 is a side view of a wheel type hydraulic excavator as an exemplary construction machine according to an embodiment of the present invention. It should be noted that an earth removing implement described in this specification is applicable to other types of construction machines on which the earth removing implement can be mounted, including a crawler type hydraulic excavator, in addition to the wheel type hydraulic excavator. In the following, a side anterior to an operator sitting in an operator's seat (left side in FIG. 1), a side posterior to the operator (right side in FIG. 1), a left side of the operator (the side closer to the viewer in a direction extending orthogonally to FIG. 1), and a right side of the operator (the side farther from the viewer in the direction extending orthogonally to FIG. 1) are defined as front, rear, left, and right of the wheel type hydraulic excavator and will be referred to simply as front side, rear side, left side, and right side. The wheel type hydraulic excavator illustrated in FIG. 1 includes a track structure 1, a swing structure 2, a work implement 3, and an earth removing implement 20.

The track structure 1 includes wheels 4 with tires. The track structure 1 further includes, though not shown in FIG. 1, a track hydraulic motor, a transmission, propeller shafts, and other parts. The track hydraulic motor is connected with the front and rear propeller shafts via the transmission. Drive forces transmitted to the front and rear propeller shafts are transmitted to the front and rear wheels 4 via front and rear axles, respectively.

The swing structure 2 is connected swingably with an upper portion of the track structure 1 via a swing device 5. A cab 6 is disposed at a front portion of the swing structure 2 on a first side in a lateral direction (left side in the embodiment). An engine, a hydraulic pump, a fuel tank, a hydraulic fluid tank, and various other types of tanks (not shown) are mounted in a rear portion of the cab 6 and are covered in a covering member 7. Additionally, a counterweight 8 is provided at a rear end of the swing structure 2. The counterweight 8 balances weight of the work implement 3 in an entire vehicle body.

The work implement 3 is provided on a second side in the lateral direction (right side in the embodiment) at a front portion of the cab 6. The work implement 3 includes a boom 11, an arm 12, and a bucket 13. Specifically, the boom 11 has a base portion connected with the swing structure 2. The arm 12 has a base portion connected with the boom 11. The bucket 13 is connected with the arm 12.

2. Earth Removing Implement

Figure 2:
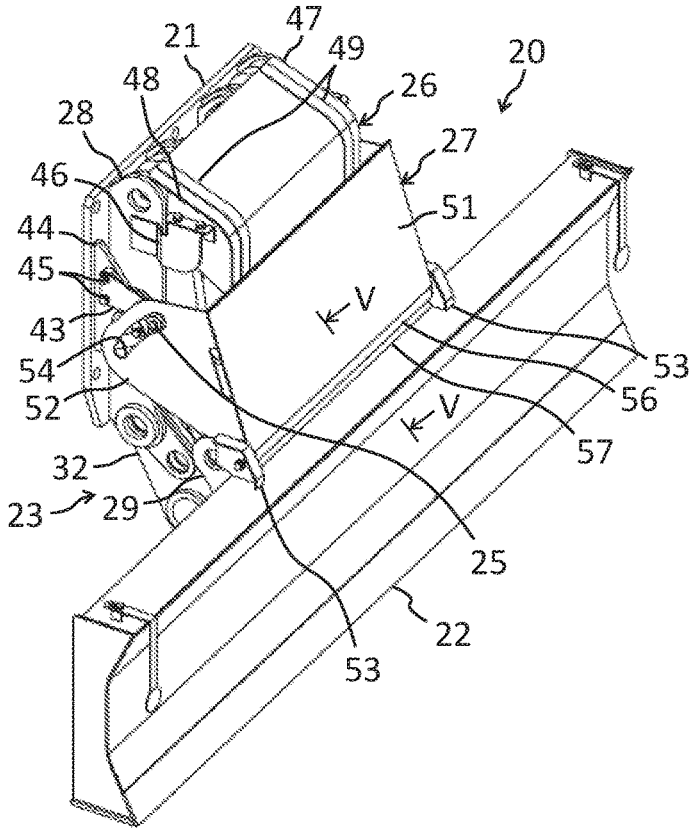
FIG. 2 is a perspective view of a blade of an earth removing implement provided for the construction machine according to the embodiment of the present invention, showing the blade lowered to a ground position.
Figure 3:
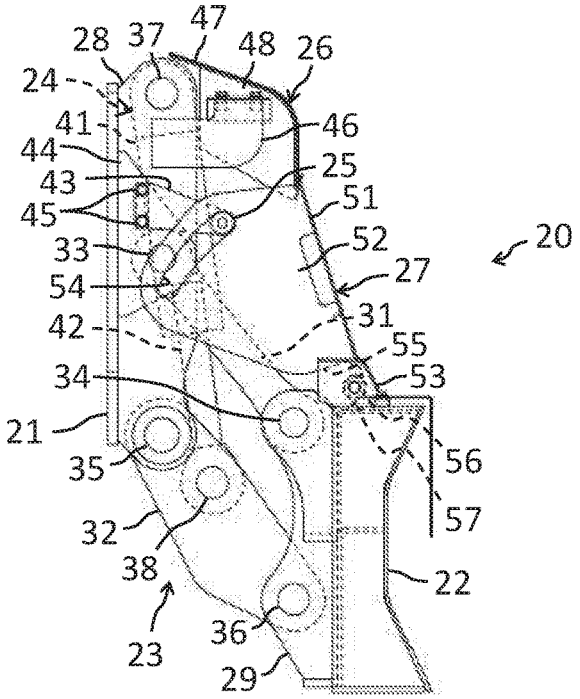
FIG. 3 is a side view of the blade of the earth removing implement provided for the construction machine according to the embodiment of the present invention, showing the blade lowered to the ground position.
Figure 4:
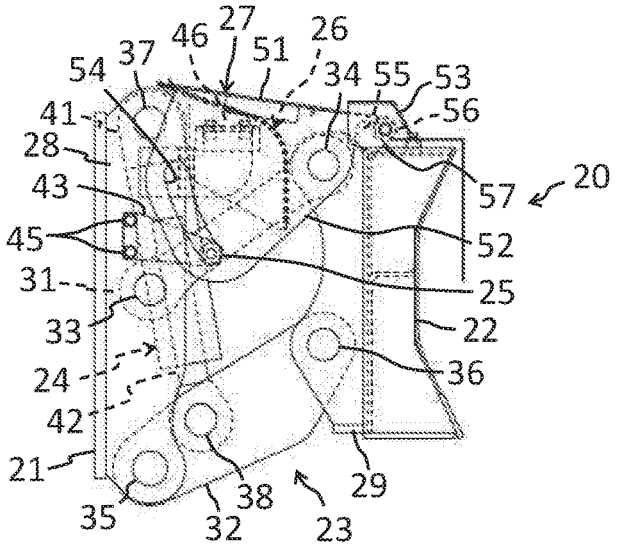
FIG. 4 is a side view of the blade of the earth removing implement provided for the construction machine according to the embodiment of the present invention, showing the blade raised to a stowed position.

The earth removing implement 20 is provided at at least either one of the front portion and a rear portion of the track structure 1. Specifically, although FIG. 1 illustrates the earth removing implements 20 provided at both the front and the rear, either one of the earth removing implements 20 may be omitted. FIG. 2 is a perspective view of the earth removing implement 20, showing a blade lowered to a ground position. FIG. 3 is a side view of the blade of the earth removing implement 20, showing the blade lowered to the ground position. FIG. 4 is a side view of the blade of the earth removing implement 20, showing the blade raised to a stowed position. The ground position, as used herein, refers to a position at which the blade contacts the ground. The ground position may be a lowest position to which the blade can be lowered (lowest position), or higher, depending on a shape of a ground surface. The stowed position, as used herein, refers to a position to which the blade can be raised away from the ground surface, specifically, a highest position.

The earth removing implement 20 shown in FIGS. 2 to 4 includes a base portion frame 21, a blade 22, a linkage mechanism 23, a cylinder 24, a guide pin 25, a fixed cover 26, and a movable cover 27.

The base portion frame 21 serves as a plate with which the earth removing implement 20 can be mounted on an end face facing the anterior-posterior direction, of a frame of the track structure 1. The base portion frame 21 is fixed to the frame of the track structure 1 by, for example, a bolt. The blade 22 has an earth removing face that faces a direction opposite to the track structure 1. With this earth removing face, the blade 22 performs an earth removing operation and stops earth and sand, for example, to prevent the earth and sand from being stagnant under the vehicle body during work. The earth removing face is recessed toward the side of the track structure 1 at a center in the vertical direction and generally stands upright in the vertical direction. The blade 22 extends in the lateral direction in a posture in which the earth removing face faces the direction opposite to the track structure 1 (facing the front for the earth removing implement 20 disposed at the front side). Specifically, the blade 22 has a longitudinal direction that extends in a width direction of the track structure 1.

The linkage mechanism 23 includes brackets 28 and 29, an upper link 31, and a lower link 32. The linkage mechanism 23 thereby connects the blade 22 with the base portion frame 21 such that the blade 22 can be raised and lowered. The bracket 28 is fixed to a front surface (surface on the side opposite to the track structure 1) of the base portion frame 21 in a posture in which the bracket 28 extends vertically. The bracket 29 is fixed to a back surface (surface on the side adjacent to the track structure 1) of the blade 22 in a posture in which the bracket 29 extends vertically. As shown in, for example, FIG. 3, the upper link 31 is connected with the brackets 28 and 29 via shafts 33 and 34 and the lower link 32 is connected with the brackets 28 and 29 via shafts 35 and 36. The shafts 33 and 34, and the shafts 35 and 36, each have a central axis extending laterally. In a vertical plane extending in the anterior-posterior direction, a straight line that passes through centers of the shafts 33 and 34 and a straight line that passes through centers of the shafts 35 and 36 are parallel with each other within an error range, and a straight line that passes through centers of the shafts 33 and 35 and a straight line that passes through centers of the shafts 34 and 36 are parallel with each other within an error range. Specifically, the linkage mechanism 23 is a parallel link, so that the blade 22 is to move in parallel arcuately and vertically without changing posture thereof. A total of two linkage mechanisms 23 (at right and left) are provided for one earth removing implement 20.

The cylinder 24 has both ends connected with the base portion frame 21 and the linkage mechanisms 23 (the lower links 32 in the present embodiment) via shafts 37 and 38. The shafts 37 and 38 each have a central axis extending laterally. The cylinder 24 extends and contracts to thereby achieve a function of raising and lowering the blade 22 with respect to the base portion frame 21. More specifically, the cylinder 24 includes a tube 41 disposed at a proximal end side thereof and a rod 42. The cylinder 24 has the tube 41 side connected with the base portion frame 21 via the shaft 37 and the bracket 28 at a position higher than the shaft 33. The cylinder 24 has the rod 42 side connected with an intermediate portion of the lower link 32 via the shaft 38. Thus, when the cylinder 24 contracts, the lower links 32 are pulled upward. This causes the linkage mechanisms 23 to rotate upwardly, thus raising the blade 22. When the cylinder 24 extends, the linkage mechanisms 23 rotates downwardly and the blade 22 is thereby lowered.

The guide pin 25 guides the movable cover 27 when the blade 22 is raised and lowered. The guide pin 25 is supported on the base portion frame 21 via a bracket 43. The bracket 43 extends toward the blade 22 and is attached by a plurality of (two in the present embodiment) bolts 45 to the base portion frame 21 (specifically, brackets 44 thereof positioned on the outside in the lateral direction of the brackets 28 of the linkage mechanisms 23). The bracket 43 has through holes (not shown), each having a diameter larger than a thread diameter of the bolts 45 and smaller than a bolt head. The bolts 45 are passed through the through holes and threaded into threaded holes in the bracket 44. This procedure fixes the bracket 43 to the bracket 44.

The fixed cover 26 is a protective member positioned above the linkage mechanisms 23 and the cylinder 24. The fixed cover 26 is fixed to the brackets 28 of the linkage mechanisms 23 via a bracket 46 and supported on the base portion frame 21 via the brackets 28 and 46. The fixed cover 26 includes a top plate portion 47 and side plate portions 48. The top plate portion 47 has a proximal end portion positioned at upper portions of the linkage mechanisms 23, specifically, upper portions of the brackets 28. The top plate portion 47 is inclined downwardly from the proximal end portion toward the blade 22 side, and has a distal end portion bent downwardly (vertically in the present example) via a rounded portion. The side plate portions 48 are disposed on the outside in the lateral direction of the linkage mechanisms 23. The fixed cover 26, being configured as described above, covers upper portions of the cylinder 24 and the right and left linkage mechanisms 23.

Reference is made to FIG. 2. The top plate portion 47 of the fixed cover 26 has an outer wall surface on which seats 49 are provided. The movable cover 27 slides over the seats 49. The seats 49 are formed in a protruding condition, extending along lines that cross the vertical planes extending in the anterior-posterior direction. Though the number of seats 49 is not specified, the present embodiment illustrates a total of two seats, one disposed on each lateral side. The seats 49 are formed of, for example, metal for smooth sliding motion with respect to the movable cover 27. Provision of such seats 49 reduces an area of contact between the movable cover 27 and the fixed cover 26, thus enabling the movable cover 27 to slide smoothly over the fixed cover 26.

The movable cover 27 is a protective member that covers a gap between the fixed cover 26 and the blade 22. The movable cover 27 includes a main surface portion 51 and side surface portions 52. The main surface portion 51 has a lower end rotatably connected with an upper surface of the blade 22 via bearing stands 53. The main surface portion 51 has an upper portion leaning on to overlap the outer wall surface of the fixed cover 26, so that the main surface portion 51 slides over the outer wall surface of the fixed cover 26 when the blade 22 is raised and lowered. The side surface portions 52 are formed by being bent from both lateral side edges of the main surface portion 51 toward the base portion frame 21 side. The side surface portions 52 each has a slot 54 with which the guide pin 25 engages. The slot 54 is formed to follow along a trajectory described by the guide pin 25 on the side surface portion 52 of the movable cover 27, when the movable cover 27 rotates by having the upper portion of the main surface portion 51 sliding over the seats 49 of the fixed cover 26 in accordance with the raising/lowering operation of the blade 22. Thus, the slot 54 has a shape that is necessarily established under a condition in which the movable cover 27 is displaced to follow the fixed cover 26. In addition, the slot 54 has a length established not to exceed the trajectory of the guide pin 25. The slot 54 is set to have a length such that the guide pin 25 engages with the slot 54 at an upper end position in the slot 54 when the blade 22 is lowered to the lowest position and that the guide pin 25 engages with the slot 54 at a lower end position in the slot 54 when the blade 22 is raised to the stowed position.

Additionally, the movable cover 27 is configured such that, when the guide pin 25 engages with the slot 54, a center of gravity thereof is positioned at all times on the side closer to the base portion frame 21 than to a pivotal point (lower end portion) connected to the blade 22. The movable cover 27 is brought down as the blade 22 is raised. The side surface portion 52 of the movable cover 27 thus has a cutout 55 provided in a lower portion thereof for avoidance of interference with an upper surface rear edge portion of the blade 22 (see FIGS. 3 and 4). In the present embodiment, the pair of bearing stands 53 provided so as to clamp the movable cover 27 from both lateral sides is formed widely toward the upper side and the rear side (the base portion frame 21 side) from portions that support a shaft of the movable cover 27, so as to overlap a space formed by the cutout 55 as viewed from lateral sides. Specifically, the bearing stands 53 serve also a function as side surface guard members covering the cutout 55.

Figure 5:
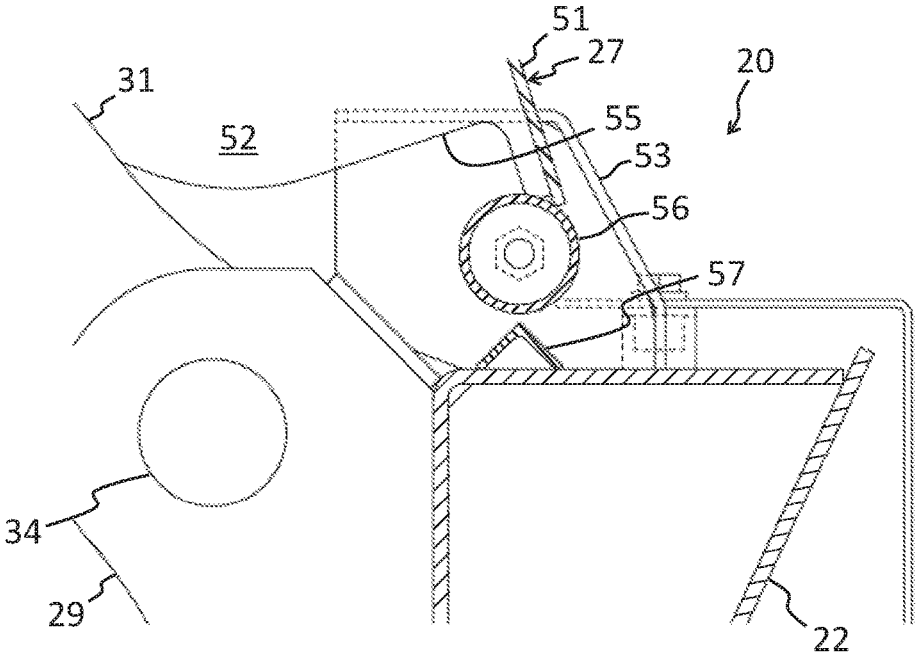
FIG. 5 is a partial cross-sectional view taken along line V-V in FIG. 2.

FIG. 5 is a partial cross-sectional view of an area near the lower end portion of the movable cover 27, taken along line V-V in FIG. 2. As shown in FIG. 5, the lower end portion of the main surface portion 51 of the movable cover 27 is formed by a pipe 56 that extends laterally. A flat surface portion of the main surface portion 51 is fixed to the pipe 56 by, for example, welding. The pipe 56 is disposed at a position on the side adjacent to the rear edge of the upper surface of the blade 22 (on the base portion frame 21 side) and retracted toward the base portion frame 21 side from the front edge of the upper surface of the blade 22. Additionally, a predetermined gap exists between the pipe 56 and the upper surface of the blade 22. A lower guard member 57 is disposed in this gap. The lower guard member 57 extends laterally in parallel with the pipe 56 so as to cover a range over which the pipe 56 extends. The lower guard member 57 is formed from, for example, an angle member. The lower guard member 57 has a cross-sectional shape (cross section cut by a vertical plane extending in the anterior-posterior direction) that is a chevron shape having slopes extending downwardly toward the front and rear from an apex. The lower guard member 57 is fixed to the upper surface of the blade 22 such that the apex is opposed to the pipe 56 as the lower end portion of the main surface portion 51 of the movable cover 27. FIG. 5 illustrates a configuration in which the apex of the lower guard member 57 is disposed immediately below the center of the pipe 56. The position at which the lower guard member 57 is disposed may nonetheless be varied as long as the position of the apex falls within a range between immediately below the front edge of the pipe 56 and immediately below the rear edge of the pipe 56. The gap between the apex of the lower guard member 57 and the pipe 56 is minimized as much as feasible.

It is noted that the lower guard member 57 is required only to have a cross-sectional shape having slopes extending downwardly toward the front and rear from the apex. Thus, for example, a pipe cut into a semi-circular half may substitute for the angle member.

Figure 6:
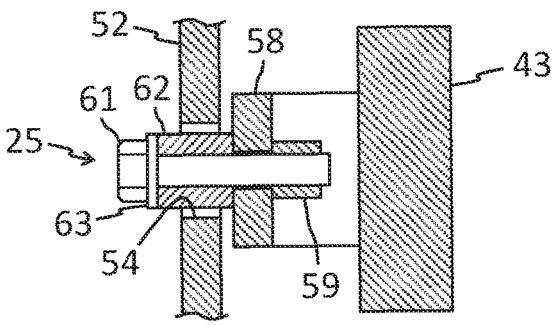
FIG. 6 is a cross-sectional view illustrating a structure of an engagement portion between a guide pin and a slot.

FIG. 6 is a cross-sectional view illustrating a structure of an engagement portion between the guide pin and the slot. As shown in FIG. 6, the guide pin 25 passes through the slot 54 provided in the side surface portion 52 of the movable cover 27. In the present embodiment, a main body of the guide pin 25 is a bolt 61. A guide pin base 58 is fixed to the bracket 43. The bolt 61 passes through a boss 62, the slot 54, and the guide pin base 58. The bolt 61 is fixed by a nut 59 attached to the guide pin base 58. The cylindrical boss 62 that covers an outer periphery of the bolt 61 is disposed inside the slot 54. A washer 63 is disposed between the boss 62 and a bolt head of the bolt 61.

Figure 7:
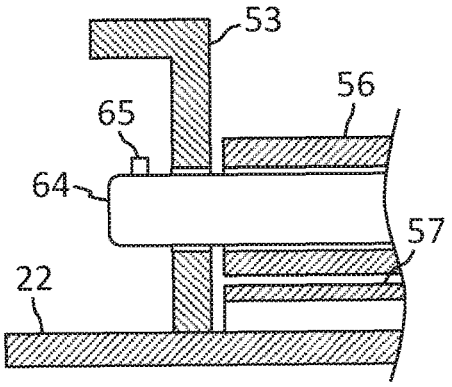
FIG. 7 is a cross-sectional view of a coupling structure between a movable cover and the blade.

FIG. 7 is a cross-sectional view of a coupling structure between the movable cover and the blade. As shown in FIG. 7, the pipe 56 that constitutes the lower end portion of the main surface portion 51 is clamped between the right and left bearing stands 53. A rotational shaft 64 passes through the bearing stands 53 and the pipe 56. A lock pin 65 is mounted at each of both ends of the rotational shaft 64. A beta pin or cotter pin, for example, may be applied as the lock pin 65.

Figure 8:
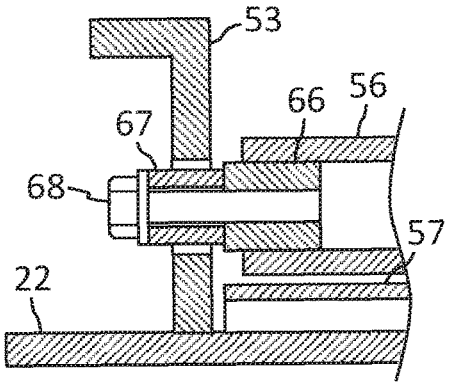
FIG. 8 is a cross-sectional view of another configuration of the coupling structure between the movable cover and the blade.

FIG. 8 is a cross-sectional view of another configuration of the coupling structure between the movable cover and the blade. In the example shown in FIG. 8, a steel bar 66 with a threaded hole machined therein at the center is inserted in and welded to both ends of the pipe 56; a collar 67 for galling prevention is passed through a through hole in the bearing stand 53; and the collar 67 is fixed to the steel bar 66 by a bolt 68. The through hole in the bearing stand 53 has a diameter smaller than an outside diameter of the pipe 56. Although the example omits a lock pin, this configuration utilizes a level difference between the collar 67 and the pipe 56 for locking the shaft.

3. Operation

To perform an earth removing operation or stop earth and sand such that the earth and sand are not stagnant under the vehicle body during such an earth removing operation, the cylinder 24 is extended from the stowed position (see FIG. 4) to thereby lower the blade 22 until the blade 22 is grounded (see, for example, FIG. 3). Because the linkage mechanism 23 that supports the blade 22 in a manner that the blade 22 can be raised and lowered is a parallel link, the extension of the cylinder 24 results in the blade 22 moving downwardly in parallel, while describing an arcuate trajectory and maintaining an upright posture. When the blade 22 lowers, the movable cover 27 connected with the blade 22 also lowers. The movable cover 27 lowers, while having the upper portion leaning on the fixed cover 26. The movable cover 27, as it lowers, gradually stands to an upright posture from a lying down posture. The upper portion of the movable cover 27 overlaps the fixed cover 26 at all times. Under a condition in which the blade 22 is lowered as shown in FIGS. 2 and 3, the gap existing in a height direction between the blade 22 and the fixed cover 26 is covered in the movable cover 27 that stands upright. Thus, the linkage mechanism 23 and the cylinder 24 are protected by the fixed cover 26 and the movable cover 27 from earth and sand or the like that may scatter and fly beyond the blade 22.

When the blade 22 is not to be used, the cylinder 24 contracts to thereby raise the blade 22 up to the stowed position (see, for example, FIG. 4). During the raising stroke, too, the blade 22 moves in parallel, while maintaining the upright posture. While the blade 22 is raising, the movable cover 27 raises, having the upper portion leaning on the fixed cover 26, and gradually lies down from the upright posture.

4. Effects (1) Prevention of Interference of Movable Cover with Swing Structure

As described previously, the guide pins 25 supported on the base portion frame 21 engage with the slots 54 provided in the side surface portions 52 of the movable cover 27. The guide pins 25, because of their being supported on the stationary base portion frame 21, are not displaced even when the blade 22 is raised or lowered. In contrast, the movable cover 27 is raised or lowered with the blade 22, so that the movable cover 27 is also raised when the blade 22 is raised toward the stowed position. As a result, the movable cover 27, and the slots 54 in the side surface portions 52 are raised to face the guide pins 25 and, when the blade 22 reaches the stowed position, the guide pins 25 arrive at the lower ends of the slots 54. Thus, should an external force act to lift the movable cover 27, the engagement between the guide pins 25 and the slots 54 restricts upward movement of the movable cover 27 at the stowed position, so that the movable cover 27 can be prevented from being lifted. Additionally, even when improper pivotal motion occurs in the movable cover 27, the slots 54 are raised to face the guide pins 25 during movement to the stowed position. This motion of the slots 54 forces the movable cover 27 into the lying down posture, so that the movable cover 27 can be smoothly stored in a space between the track structure 1 and the swing structure 2. The prevention of the movable cover 27 from being lifted at the stowed position enables interference between the movable cover 27 and the swing structure 2 to be prevented and damage of, for example, the movable cover 27 to be prevented.

(2) Prevention of Forward Tilt of Movable Cover

The guide pins 25 are disposed at upper positions in the slots 54 at the ground position. Under a condition in which the guide pins 25 are disposed in the slots 54, the center of gravity of the movable cover 27 is disposed at all times on the side closer to the base portion frame 21 than to the lower end portion as the pivotal point. This feature can prevent the movable cover 27 from tilting to the side opposite to the base portion frame 21.

(3) Prevention of Wedging by Pivotal Portion of Movable Cover

The earth removing implement 20 lowered to the ground position is included in a movable range of the bucket 13. The pipe 56 that assumes the pivotal point for the movable cover 27 is, however, disposed at a position retracted from the front edge of the blade 22, so that deformation, for example, caused by interference with the bucket 13 during, for example, a scooping operation can be prevented. Meanwhile, the upper surface of the blade 22 is exposed in areas on the side closer to the work implement 3 with respect to the movable cover 27. As a result, earth and sand tend to be stagnant on the surface of the blade 22 in areas near the lower end portion of the movable cover 27.

The earth removing implement 20 in the present embodiment thus includes the lower guard member 57 provided on the upper surface of the blade 22. The pipe 56 is disposed close to the lower guard member 57 that serves as a gate. The lower guard member 57 stops earth and sand that scatter and fly over to the upper surface of the blade 22. Because the gap between the lower guard member 57 and the pipe 56 is narrow, earth and sand hardly pass therethrough. Should earth and sand be wedged in the gap between the lower guard member 57 and the pipe 56, the area of contact between the wedged earth and sand and the lower guard member 57 is minimal because of the apex of the lower guard member 57 facing the pipe 56. Thus, the wedged earth and sand do not tend to be stagnant in the gap. The wedged earth and sand thus fall down due to, for example, machine vibrations or other external force and fall over the slopes of the lower guard member 57 to be eventually discharged. Should the wedged earth and sand not fall down during operations, an outer peripheral surface of the pipe 56 that is in contact with the wedged earth and sand is opposed to the wedged earth and sand and rotates toward the side opposite to the base portion frame 21 during stowing of the blade 22. Thus, the earth and sand wedged during operations fall down onto the side opposite to the base portion frame 21 while the blade 22 is being stowed. This prevents entry of earth and sand from below the movable cover 27. Together with the prevention of wedging of earth and sand, the foregoing can prevent smooth operation of the movable cover 27 from being degraded.

(4) Assemblability

As described previously, the slot 54 in the movable cover 27 is formed to follow along the trajectory described by the guide pin 25 that faces the movable cover 27 displaced as the blade 22 is raised and lowered. The movable cover 27 is connected rotatably with the blade 22 and displaced to follow the fixed cover 26. As a result, due to deviation in the trajectory of the blade 22 arising from a manufacturing error or assembly error of the linkage mechanism 23 and the blade 22 or from a manufacturing error or assembly error of the fixed cover 26, it is difficult to perfectly match the trajectory described by the guide pin 25 with respect to the movable cover 27 with engineering data. It is not easy to match the slot 54 in the movable cover 27 that makes a combined operation of rotary motion and tilting motion with the trajectory of the guide pin 25. Thus, in the present embodiment, the bracket 43 that supports the guide pin 25 is fixed to the base portion frame 21 by the bolts 45. Because of a difference in diameter existing between the bolt holes provided in the bracket 43 and the bolts, the angle of the bracket 43, or the position of the guide pin 25 can be easily adjusted by simply loosening the bolts 45. Thus, the guide pin 25 can be readily adjusted to the trajectory of the slot 54 being displaced. This achieves assemblability of the earth removing implement 20.

(5) Miscellaneous

The side surface portion 52 of the movable cover 27 normally has the cutout 55 formed therein for avoidance of the interference with the blade 22. Earth and sand that may scatter and fly past the cutout 55 thus can collide with the linkage mechanism 23 and the cylinder 24. In the present embodiment, however, the cutout 55 is covered in the bearing stands 53 that serve as the side surface guard members, so that the linkage mechanism 23 and the cylinder 24 can be reliably protected from the earth and sand that scatter and fly from lateral directions of the movable cover 27. In the present embodiment, in particular, the bearing stands 53 that support the movable cover 27 are configured to serve also as the side surface guard members. This arrangement yields merits, including a reduced number of parts used and a simplified structure. It should, however, be noted that, for the purpose of simply covering the cutout 55, the bearing stands 53 do not necessarily have to serve also as the side surface guard members. Specifically, the earth removing implement 20 may include the side surface guard members separately from the bearing stands.

Although the construction machine to which the earth removing implement 20 is applied is not limited only to the wheel type hydraulic excavator as described previously, the present embodiment has been described for a case in which the earth removing implement 20 is applied to the wheel type hydraulic excavator. With the wheel type hydraulic excavator, it is important to raise the blade 22 to the stowed position close to the swing structure 2 to thereby allow a distance between the blade 22 and the ground surface in order to gain a departure angle. Thus, the earth removing implement 20 that allows the blade to be raised up to the stowed position can be desirably applied to the wheel type hydraulic excavator.

What is claimed is:

1. A construction machine comprising:

a track structure;

a swing structure provided swingably at an upper portion of the track structure; and an earth removing implement provided at at least either a front portion or a rear portion of the track structure, the earth removing implement including:

a base portion frame mounted on the track structure;

a blade mounted on the base portion frame by using a linkage mechanism and a cylinder such that the blade can be raised and lowered;

a fixed cover supported on the base portion frame and positioned above the linkage mechanism;

a movable cover that covers a gap between the fixed cover and the blade; and a guide pin that guides the movable cover while the blade is being raised and lowered, wherein the guide pin is supported on the base portion frame, the movable cover includes a main surface portion having a lower end connected rotatably with the blade and having an upper portion leaning on the fixed cover, the movable cover further including a side surface portion having a slot with which the guide pin engages, and the slot is formed along positions of the side surface portion of the movable cover facing the guide pin when the movable cover rotates by having the upper portion of the main surface portion sliding over the fixed cover in accordance with a raising/lowering operation of the blade, the slot being configured such that the guide pin engages with the slot at a lower end position therein when the blade is raised to a highest position.

2. The construction machine according to claim 1, wherein the movable cover is configured such that a center of gravity thereof is positioned on a side closer to the base portion frame than to a pivotal point thereof when the guide pin engages with the slot.

3. The construction machine according to claim 2, wherein a lower guard member is provided on an upper surface of the blade so as to be opposed to the lower end of the main surface portion of the movable cover, the lower guard member extending laterally and having a cross section that has slopes extending downwardly toward a front and a rear from an apex of the lower guard member.

4. The construction machine according to claim 2, wherein a bracket that supports the guide pin with respect to the base portion frame is attached to the base portion frame by using a bolt.

5. The construction machine according to claim 2, wherein a cutout for avoidance of interference with the blade is provided in the side surface portion of the movable cover, and a side surface guard member that covers the cutout is mounted on the blade.

* * * * *